US010962027B2

(12) United States Patent
Smith et al.

(10) Patent No.: US 10,962,027 B2
(45) Date of Patent: Mar. 30, 2021

(54) SUCTION PUMPS

(71) Applicant: Thermofluidics Ltd., Oxford (GB)

(72) Inventors: Thomas C. B. Smith, Oxford (GB); Thomas Robert Law, Oxford (GB); Bart Stockman, Devon (GB)

(73) Assignee: THERMOFLUIDICS LTD.

( * ) Notice: Subject to any disclaimer, the term of this patent is extended or adjusted under 35 U.S.C. 154(b) by 52 days.

(21) Appl. No.: 16/329,535

(22) PCT Filed: Sep. 1, 2017

(86) PCT No.: PCT/GB2017/052550
§ 371 (c)(1),
(2) Date: Feb. 28, 2019

(87) PCT Pub. No.: WO2018/042188
PCT Pub. Date: Mar. 8, 2018

(65) Prior Publication Data

US 2019/0195244 A1 Jun. 27, 2019

(30) Foreign Application Priority Data

Sep. 2, 2016 (GB) ..... 1614962

(51) Int. Cl.
*F04F 1/08* (2006.01)
*F04F 5/10* (2006.01)
(Continued)

(52) U.S. Cl.
CPC ..... *F04F 1/08* (2013.01); *F04F 1/06* (2013.01); *F04F 5/10* (2013.01); *F04F 7/02* (2013.01); *F04B 19/003* (2013.01); *F04B 31/00* (2013.01)

(58) Field of Classification Search
CPC ..... F04F 1/08; F04F 1/06; F04F 5/10; F04F 7/02; F04B 19/003; F04B 31/00
See application file for complete search history.

(56) References Cited

U.S. PATENT DOCUMENTS 799,428 A 9/1905 Waclaw
3,123,009 A 3/1964 Watson
(Continued)

FOREIGN PATENT DOCUMENTS

DE 804288 C 4/1951
FR 435032 1/1912
(Continued)

OTHER PUBLICATIONS

International Search Report and Written Opinion for corresponding international application No. PCT/GB2017/052550, dated Jan. 15, 2018.

*Primary Examiner* — Peter J Bertheaud
*Assistant Examiner* — Dnyanesh G Kasture
(74) *Attorney, Agent, or Firm* — Tarolli, Sundheim, Covell & Tummino LLP

(57) ABSTRACT

A liquid suction pump comprising: a drive pipe to receive a liquid drive flow for the pump; a liquid conduit with first and second liquid delivery arms to provide pumped liquid, and a connecting valve arrangement between the arms. First and second pump inlets to the arms have respective first and second one-way inlet valves. The valve arrangement has a valve inlet coupled to the drive pipe and valve outlets coupled to the arms to alternately close off a liquid connection between the valve inlet and respective arms. A compliant element is coupled to the drive pipe. The drive flow oscillates in pressure/flow rate due to alternate switching of the valves. A compliance of the compliant element is such that a geometry of the suction pump in combination with the compliance defines a resonant condition, and the oscillation is at a resonant frequency of the pump.

27 Claims, 13 Drawing Sheets

(51) Int. Cl.

| | |
|---|---|
| ***F04F 7/02*** | (2006.01) |
| ***F04F 1/06*** | (2006.01) |
| *F04B 19/00* | (2006.01) |
| *F04B 31/00* | (2006.01) |

(56) References Cited

U.S. PATENT DOCUMENTS

| | | | | |
|---|---|---|---|---|
| 4,121,895 | A | 10/1978 | Watson | |
| 4,441,316 | A * | 4/1984 | Moody | F03B 13/142 60/398 |
| 4,948,341 | A | 8/1990 | Cyphelly | |
| 6,234,764 | B1 | 5/2001 | Obermoser | |
| 2004/0234392 | A1 * | 11/2004 | Ghoshal | F04F 1/06 417/410.1 |
| 2013/0302182 | A1 | 11/2013 | Smith | |

FOREIGN PATENT DOCUMENTS

| | | | |
|---|---|---|---|
| GB | 191225143 | A | 12/1912 |
| WO | 2010130002 | A1 | 11/2010 |

* cited by examiner

SUCTION PUMPS

RELATED APPLICATIONS

The present invention is a U.S. National Stage under 35 USC 371 patent application, claiming priority to Serial No. PCT/GB2017/052550, filed on 1 Sep. 2017; which claims priority of UK 1614962.7, filed on 2 Sep. 2016, the entirety of both of which are incorporated herein by reference.

FIELD OF THE INVENTION

This invention relates to liquid suction pumps, of the type which may be called suction rams, and to methods of operating such pumps. Example applications of such pumps include pumping water from wells, boreholes and the like.

BACKGROUND TO THE INVENTION

Suction rams may be divided into two broad categories, single acting and double acting, as follows:

Single Acting: Those having a single drive pipe and delivery pipe, an impulse valve between the drive pipe and delivery pipe, a single intake non-return valve situated immediately downstream of the impulse valve. Most examples incorporate an accumulator connected to the bottom of the drive pipe to store the kinetic energy in the drive pipe and to limit damage to the apparatus due to the production of un-exploited discharge shock waves.

Examples are described in U.S. Pat. No. 799,428, DE804288, and U.S. Pat. No. 4,948,341. They tend to stall readily in the closed position, requiring the drive pressure to be relieved before a renewed attempt can be made at starting. AU708806 addresses this difficulty, but in all single-acting hydraulic suction ram pumps comprising an accumulator, the minimum pressure in the accumulator occurs at a time when the impulse valve is already open, and thus cannot be exploited as a means of re-opening.

Double Acting: Those having a single drive pipe but two delivery pipes, each connected to an intake non-return valve, wherein the impulse valve is a diverter valve such that when in operation, either of the two delivery pipes is closed at any one time but not the other.

Examples are described in FR435032, U.S. Pat. Nos. 3,123,009, 4,121,895. A more recent example is described in WO2010/130002, but this pump is difficult to set up and relatively inefficient.

More generally, existing double-acting suction rams have the disadvantage of a trade-off between the ability of the valve to switch from one delivery pipe to the other, and the flow-friction loss around the impulse/diverter valve. Either the switching occurs at low flow rates but the flow is relatively choked or the switching only occurs at high flow rates.

The inventors have conducted practical and theoretical investigations of the underlying fluid dynamics and have identified surprising and substantial improvements which may be made.

SUMMARY OF THE INVENTION

According to a first aspect of the invention there is therefore provided a liquid suction pump, the pump comprising: a drive pipe to receive a liquid drive flow for the pump; a liquid conduit having first and second liquid delivery arms to provide pumped liquid, and a connecting valve arrangement between the arms; first and second pump inlets to said first and second arms, said first and second pump inlets having respective first and second one-way inlet valves; said valve arrangement having a valve inlet coupled to said drive pipe and valve outlets coupled to said first and second arms, to alternately close off a liquid connection between said valve inlet and respective ones of said first and second arms; and a compliant element coupled to said drive pipe; wherein the suction pump is configured such that, in operation, said drive flow oscillates in pressure/flow rate due to alternate switching of said valve arrangement; and wherein a compliance of said compliant element is such that a geometry of said suction pump in combination with said compliance defines a resonant condition for said pump and said oscillation is at a resonant frequency of the pump.

Broadly speaking embodiments of the suction pump rely on a self-sustaining oscillation. However the inventors have determined that, surprisingly, if the compliance of the compliant element is properly set this will co-operate with the inertance of the delivery arms (and to second order other features of the pump) so that the oscillation is effectively at a resonant frequency of the pump. The self-sustaining oscillation can readily be driven by the drive flow without such a resonant condition existing, but by tuning the compliance of the compliant element the system can be brought into a resonant condition where, in embodiments, improvements in pumping efficiency of 10-20% may be observed. In principle other elements of the pump may be tuned to adjust the resonant condition but in practice this is difficult, typically because factors such as the length and area of the delivery and drive pipes are determined by the environment in which the pump is intended to operate, for example the depth of the pump.

In operation the drive flow typically oscillates in both pressure and flow rate, although one or the other may predominate (typically both the flow rate and pressure are relatively constant with an imposed ripple of around 10%, typically larger at the compliant element). In embodiments the amplitude of the pressure variation at the valve arrangement is sufficient to switch the valve arrangement between its alternate positions, in particular when the pressure at the valve inlet is at a minimum. In broad terms this may be considered as "sucking" the valve from a first position to an alternate position. In embodiments an amplitude of the pressure variation at or in the compliant element is equal to or greater than a differential in pressure across the valve arrangement between the valve inlet and a closed-off valve outlet, and thus the "suction" is sufficient to move the valve between its alternate positions. In this way the resonant operation of the pump may be responsible for switching the valve and, in embodiments, the switching may be achieved substantially without any venturi effect and/or viscous drag to assist the switching. This is advantageous because introduction of a venturi to cause a pressure reduction is achieved by constricting the fluid flow, which is undesirable; the introduction of viscous drag is similarly undesirable.

In preferred embodiments the compliant element is located at or adjacent the valve arrangement as this facilitates achieving the aforementioned condition. In one approach this may be achieved by implementing the compliant element as a chamber incorporating a gas-filled region; in this case conveniently the chamber may be located in or around the valve arrangement. Such a configuration also facilitates making the compliance of the compliant element tuneable or adjustable in order that the pump can be tuned into resonance. Nonetheless, however the compliant element is arranged, in preferred embodiments the compliance of this element is selected to be sufficiently small that the pressure variation at the inlet to the valve arrangement is sufficient to actuate the switching.

In one alternative arrangement the compliant element comprises a spring-loaded piston or diaphragm. This may be provided with an end-stop screw to pre-load the spring. Preferably the compliant element pre-load is adjustable to compensate for a time averaged difference between the pressure in the compliant element and an external pressure—in embodiments to allow for the hydrostatic pressure in the apparatus being higher at greater pumping depths, whilst the back-side of the piston or diaphragm remains at atmospheric pressure. For example in one embodiment a screw thread provides a linearly adjustable preload of, say, one turn per meter pump depth compensation; this may be set during installation. If a spring (or other compliant element) with a non-linear response is employed, changing the pre-load may also be used to adjust the compliance.

In a still further approach the compliant element may be implemented by providing the drive pipe with an elastic chamber or region. In embodiments the elastic chamber or region may contain the valve arrangement.

The skilled person will appreciate that there are many variations of valve arrangements which may be employed in the pump. In broad terms the valve arrangement operates to divert the drive flow into either the first or the second delivery arm. It may thus comprise a moveable paddle, or a ball or other element which is able to shuttle back and forth within a length of pipe between end stops to either side of the valve inlet, or some other configuration may be used. In practice because of the relatively confined space in which the pump may be constrained to operate, for example because it is down a narrow well, such a shuttle valve arrangement may be orientated vertically rather than horizontally. Where a paddle is employed the paddle may be hinged or otherwise mounted for rotation about a vertical axis, for example so that it can swing back and forth circumferentially about this axis into sealing engagement with one or more apertures. This helps the valve arrangement to fit within a small diameter, which in turn facilitates the arrangement fitting into a borehole.

In a related aspect the invention provides a method of operating a suction pump as described above and later, the method comprising: flowing liquid substantially continuously into said drive pipe and out alternately through each of said delivery arms, and sucking further liquid into the inlet valve of each delivery arm as liquid from the drive pipe is flowing out through the arm; and selecting or adjusting a compliance of said compliant element such that the geometry of said suction pump in combination with said compliance defines a resonant condition for said pump.

As previously described in embodiments the compliance of the compliant element is selected (for example by choosing an appropriate compliant element) or adjusted so that in combination with the geometry of the suction pump it defines a resonant condition for the pump. The inventors have established that one of the main factors in the geometry of the pump governing the resonant condition is the inertance of the (liquid in the) delivery arms in combination with the compliance. This (fluid) inertance is proportional to the density of the fluid and the length of the pipe and inversely proportional to the internal cross-sectional area of the pipe.

In embodiments the pump is operated with a substantially constant flow rate of drive flow. Then the resonance condition may be substantially entirely dependent upon the inertance in the delivery arms. Alternatively the pump may be operated with a substantially constant pressure drive flow, for example provided by a header tank. In this case inertance in the drive pipe, and thus the geometry (length/diameter) of the drive pipe, also has an influence on the resonant condition.

An output power for the pump may be defined as a product of a difference between the input and output pressures and a difference between the volume flow rates of the drive input flow and the output flow. In a typical application, where the pump is used for a well, the difference in pressures can be equated to the hydrostatic pressure or lift of the well. An input power for the pump may be defined as and the product of the drive input flow and the drive pressure which may be defined as the difference in pressure between the inlet to the drive pipe and the outlet of the delivery pipes. An efficiency for the pump may be defined as the ratio of the said output power to the said input power. With this definition of efficiency, improvements in efficiency of around 20% may be achieved, as previously mentioned.

In a related aspect the invention provides a method of operating a liquid suction pump, the pump comprising: a drive pipe to receive a liquid drive flow for the pump; a liquid conduit having first and second liquid delivery arms to provide pumped liquid, and a connecting valve arrangement between the arms; first and second pump inlets to said first and second arms, said first and second pump inlets having respective first and second one-way inlet valves; said valve arrangement having a valve inlet coupled to said drive pipe and valve outlets coupled to said first and second arms, to alternately close off a liquid connection between said valve inlet and respective ones of said first and second arms; and a compliant element coupled to said drive pipe; the method comprising: operating the suction pump such that said drive flow oscillates in pressure/flow rate due to alternate switching of said valve arrangement, and such that an amplitude of the pressure variation in or at the compliant element is equal to or greater than a differential in pressure across the valve arrangement between the valve inlet and a closed-off valve outlet; locating said compliant element at or adjacent said valve arrangement; and switching said valve arrangement between alternate positions when a pressure at said valve inlet is at or close to a minimum.

As described later, the compliance of the compliant element, in particular in combination with a characteristic inertance of the drive and delivery pipes, may define a resonance frequency that may advantageously be set to an operational frequency of the suction pump, in embodiments, by setting a value for a product of compliance and this characteristic inertance, in particular dependent upon $l^2$ where/is the length of a delivery pipe (or an average length if the lengths are different), and c where c is a speed of sound in the liquid contained within the delivery pipes. As described later, this can also set the pump driver to a best efficiency point, in particular by choosing an inertance for the delivery and/or drive pipes, for example, by setting the internal cross-sectional areas thereof.

In embodiments a pump driver which provides the drive flow may be a drive pump, located at surface level or otherwise. The drive pump may comprise a displacement pump which may provide a substantially constant drive flow or it may comprise a centrifugal pump and accumulator, that may provide a varying drive flow at substantially constant inlet pressure. As previously mentioned, in other arrangements the pump driver may comprise, for example, a header tank. The resonance frequency of the suction pump may simultaneously be set to a value that also forces the drive pump to operate at its best efficiency by setting a ratio of compliance to the characteristic inertance that sets an input impedance Z (ratio of pressure:flow) of the pump to a value $Z_{BEP}$ which is substantially equal to the ratio drive pressure: drive flow rate at the best efficiency point on the drive pump's characteristic pressure/flow rate curve. According to this example, the compliance, and the characteristic inertance I may be set such that one or both of the conditions below is met:

$$C \leq \frac{4nl}{\pi^2 c Z_{BEP}}$$

$$I \leq \frac{nlZ_{BEP}}{c}$$

with c the speed of sound in the liquid contained in a delivery pipe, l the length of a delivery pipe (or an average length if the lengths are different), and n the number of out and return expansion wave passages that may take any integer valve that may depend on the relative size (scale) of the suction pump drive pump and the pumped delivery head. (However, as described later, when friction is taken into account the above inequality for C may change to $$C \approx \frac{4nl}{\pi^2 c Z_{BEP}}$$

or even $$C \geq \frac{4nl}{\pi^2 c Z_{BEP}}\Big).$$

The best global efficiencies may generally be obtained when n=1, although it may be preferable to operate the pump with n>1, for example, to preserve the lifetime of components and/or where pipe diameters are constrained by the application and/or where high ratios of drive and delivery pressures are desired.

The characteristic inertance, I, may be defined as follows:

In a system in which a combination of the pump and pump driver is configured such there is a constant drive pipe flow $I=I_L$, where is $I_L$ the delivery pipe inertance (or an average delivery pipe inertance).

In a system in which a combination of the pump and pump driver is configured such there is a constant inlet pressure to the drive pipe $I=I_L I_D/(I_L+I_D)$ where $I_D$ is the (or an average) drive pipe inertance.

The skilled person will appreciate that, for a particular practical pump and pump driver combination, the characteristic inertance may be determined from pipe lengths and cross-sectional areas of the apparatus.

The equations presented above may define an optimum for an idealised inviscid case and the optimal compliance and inertance values may be less than these values due to the effects of flow-friction.

The invention further provides a pump comprising means to implement this method.

In a further related aspect the invention provides a liquid suction pump, the pump comprising: a drive pipe to receive a liquid drive flow for the pump; a liquid conduit having first and second liquid delivery arms to provide pumped liquid, and a connecting valve arrangement between the arms; first and second pump inlets to said first and second arms, said first and second pump inlets having respective first and second one-way inlet valves; said valve arrangement having a valve inlet coupled to said drive pipe and valve outlets coupled to said first and second arms, to alternately close off a liquid connection between said valve inlet and respective ones of said first and second arms; and a compliant element coupled to said drive pipe; wherein the suction pump is configured such that, in operation, said drive flow oscillates in pressure/flow rate due to alternate switching of said valve arrangement; and wherein a compliance of said compliant element is adjustable.

As described above, the compliance of the compliant element may be chosen so that it defines a resonant condition for the pump. This may be done during the design stage of the pump, or the compliance of the compliant element may be selectable or adjustable. However in embodiments the pump may be resonant over a relatively broad band such that there may not be a need for the compliance to be adjustable in situ for tuning to resonance. Nonetheless it can be useful for other reasons for the compliance to be adjustable. One reason is that changing the compliance chosen changes the impedance of the whole apparatus.

The ability to change the (input) impedance of the pump apparatus is useful as it enables the apparatus to be matched to the power point of a range of different drive systems—for example a mechanical drive, a centrifugal or impeller pump, a positive-displacement pump, or a heat engine (see our previously filed patent application WO2005/121539, hereby incorporated by reference).

In addition, adjusting the compliance will also change the resonant frequency. This can be useful as it allows better matching to an optimum frequency of operation of the drive. In particular adjusting the compliance can increase the resonant frequency away from a region where the drive pump is inefficient, for example a low frequency region where there is high flow and low differential pressure. Thus providing a variable compliance facilitates tuning the resonance frequency and also the impedance that the pump presents to the drive system.

Thus in a further aspect the invention provides a method of operating a liquid suction pump, the pump comprising: a drive pipe to receive a liquid drive flow for the pump from a pump driver; a liquid conduit having first and second liquid delivery arms to provide pumped liquid, and a connecting valve arrangement between the arms; first and second pump inlets to said first and second arms, said first and second pump inlets having respective first and second one-way inlet valves; said valve arrangement having a valve inlet coupled to said drive pipe and valve outlets coupled to said first and second arms, to alternately close off a liquid connection between said valve inlet and respective ones of said first and second arms; and a compliant element coupled to said drive pipe; the method comprising: selecting or adjusting a compliance of said compliant element to match an impedance and/or resonant frequency of the liquid suction pump to said pump drive, more particularly selecting or adjusting a compliance of said compliant element to match a resonant frequency of the liquid suction pump to said pump driver and/or selecting or adjusting a compliance of said compliant element to bring a resonant frequency of the pump into line with an operational frequency of the pump.

In the above and previously described aspects of the invention it has been observed that by setting the compliance such that a pump resonance matches a frequency at which the pump is operating a surprising increase in the efficiency of the suction pump is achieved.

It has also been determined that the efficiency of the drive pump can be maximised, in particular by setting a characteristic inertance and/or by setting/adjusting the compliant element to match the input impedance (pressure difference between the drive pipe inlet and the delivery pipe outlets divided by the drive flow rate input) of the suction pump to an optimal impedance of the pump drive. The optimal impedance of the pump drive is typically determined from a head-flow curve for the pump drive, for example defining a point of maximum (hydraulic) efficiency. The pump drive and input impedance may each be defined as a ratio of drive pump head or pressure to drive pump flow.

It has been discovered that in a practical pump these two efficiencies can be optimised simultaneously, as described later. In particular this may be achieved by scaling the compliance and a characteristic inertance of the pump dependent upon i) a length of one or both delivery arms (which may have substantially the same length) and a speed of sound in the liquid contained within the delivery pipes and iii) an optimal impedance applied to the pump drive.

The invention further provides a method of manufacturing a suction pump as described above. The method comprises designing the suction pump as specified above; and then manufacturing the suction pump according to the design.

BRIEF DESCRIPTION OF THE DRAWINGS

These and other aspects of the invention will now be further described, by way of example only, with reference to the accompanying figures in which.

DETAILED DESCRIPTION OF PREFERRED EMBODIMENTS

Figure 1:
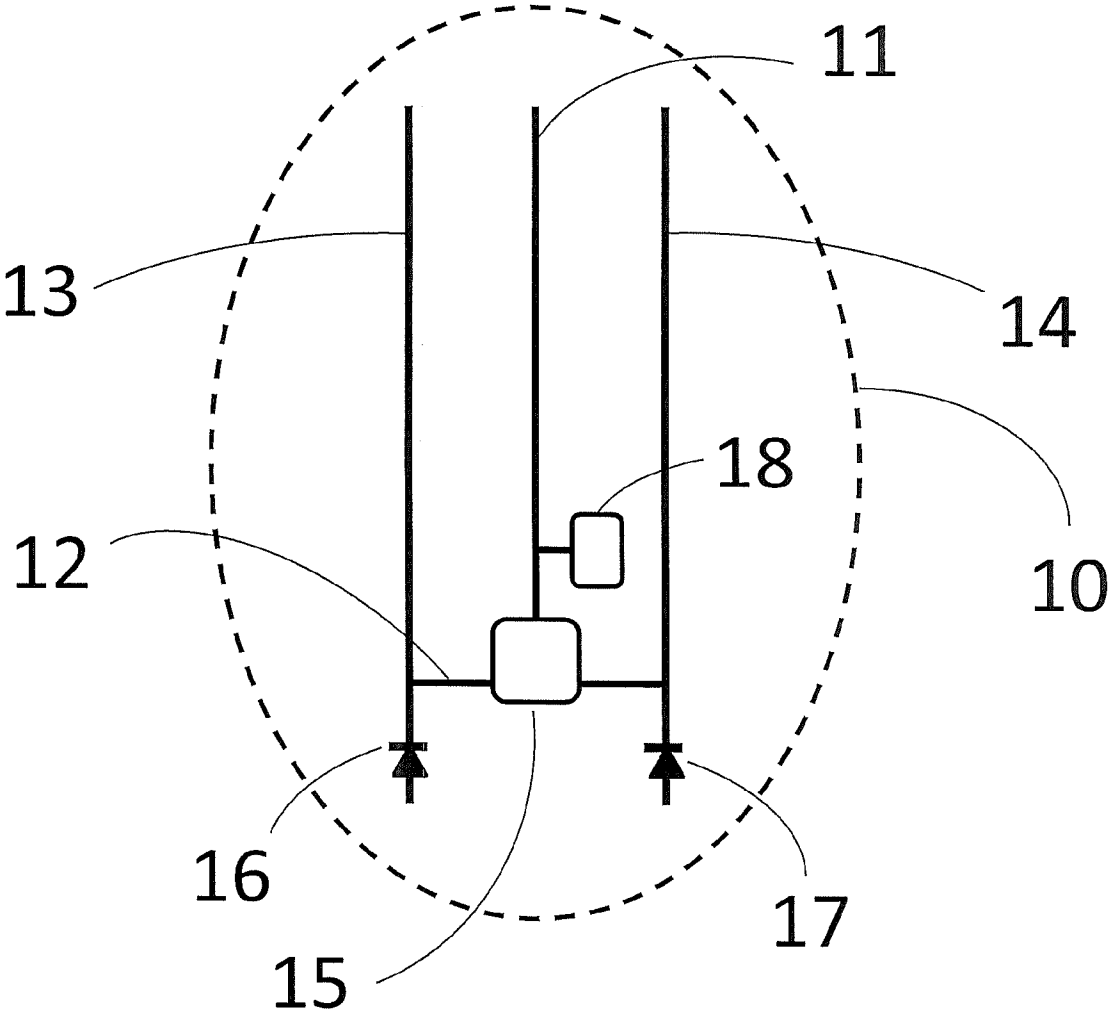
FIG. 1 shows a liquid suction pump according to an embodiment of the invention.

We will describe hydraulic ram pumps, in which drive liquid is provided at a higher pressure and discharged at a lower pressure in order to accelerate a liquid column increasing its kinetic energy, the kinetic energy being converted into pumping energy by the Joukowski effect. More specifically, we will describe suction rams, where the input power source is at a substantially higher level or pressure than the liquid to be pumped.

Hydraulic ram pumps involve accelerating a liquid column contained in a drive pipe to a "final velocity" which is greater than the "Joukowski velocity, which is equal to $$v_J = \frac{p}{\rho c}$$

where p is the total pressure lift of the pump, p is the density of the pumped liquid and c is the speed of sound in the pumped liquid contained within the pipe or pipes into which liquid is sucked.

This final velocity can take any value above the Joukowski velocity, but is advantageously chosen to maximise the ratio of kinetic energy to work done overcoming flow-friction losses in accelerating the liquid to that velocity. The liquid is brought to a sudden standstill by an impulse valve. The pressure of liquid upstream of the impulse valve increases to the discharge pressure of the pump whereas the liquid downstream of the impulse valve decreases to the suction pressure of the pump. The energy available for conversion to discharge work is equal to the kinetic energy upstream of the impulse valve immediately prior to closure and the energy available for conversion to suction work is equal to the kinetic energy downstream of the impulse valve immediately prior to closure thereof. The duration of the discharge event is equal to the time taken to dissipate a discharge shock that propagates upstream of the impulse valve and the duration of the suction event is equal to the time taken to dissipate an expansion wave that propagates downstream thereof. A suction ram design should aim to substantially minimise the magnitude of the discharge shock and maximise and exploit the expansion wave.

Embodiments of the suction pumps we describe are used to raise liquid from a substantially lower level or pressure to a higher level or pressure, powered by a (circulating) liquid flow which may be driven by various possible means at a level or pressure between the other levels or pressures.

Thus we will describe a double-acting suction ram pump in which a diverter valve is actuated by means independent of the Venturi effect, or viscous-drag, alternately coupling a drive pipe to one of two liquid delivery arms. This is achieved by encouraging a pressure variation in a compliant element at or close to the inlet of the diverter valve.

This pressure variation depends on a coupling between the compliant element and the inertance in the liquid delivery arms and the drive pipe, that can be regarded as a resonance of the system. In embodiments the amplitude of this resonant variation is made greater than or equal to the seating force on the valve; this is facilitated by maintaining the compliance of the compliant element at a very low level. This may be further facilitated by arranging the valve such that it is easy/fast to operate. This can be achieved by reducing the sealing area of the valve seats and/or providing a low-resistance liquid path around the sealing element(s), for example by increasing a cross-sectional area of a region where the liquid flows around and to the back of a sealing element during valve operation.

This contrasts with double-acting suction rams in which the Venturi effect or viscous drag causes switching: Typically the encouragement of Venturi forces necessitates that the cross-sectional flow area is substantially constricted in the vicinity of the sealing faces. This results in high flow friction losses when the valve is open and high valve actuation force and/or slow valve actuation. This switching is at a frequency higher than any resonant frequencies, which are low because of the large compliance of their air-volumes/accumulators.

In embodiments a drive pipe is connected to a diverter valve inlet and a compliant element. The diverter valve outlets are connected to two liquid delivery arms. Each liquid delivery arm is connected to a one-way valve inlet. The compliance of the compliant element is set to raise the pressure amplitude to a level wherein, in operation it is sufficient to actuate the diverter valve by momentarily reversing the seating pressure thereupon.

A complete pumping cycle is characterised by an acceleration phase and a delivery phase in both liquid delivery arms. The two liquid delivery arms operate in anti-phase: the acceleration phase occurs in one liquid delivery arm whilst the delivery phase occurs in the other delivery arm. The principal function of the compliant element is, when coupled to an inertance of the drive pipe and one of the liquid delivery arms, to provide an efficient means of actuating the diverter valve at the most appropriate point in the pumping cycle.

Two acceleration phases thus take place during a complete pumping cycle. An acceleration phase causes the compliant element first to compress and then expand over each one-half of a pumping cycle. The pressure drop in the accumulator corresponding to the expansion of the compliant element causes the seating force on the diverter valve to reverse momentarily, causing it to actuate.

As the diverter valve actuates, the flow in the open liquid delivery arm is rapidly cut-off, causing a reduction in pressure in that liquid delivery arm to a level that causes the one-way inlet valve connected thereto to open, and liquid to be drawn in until the flow decelerates to zero.

The compliance of the compliant element is preferably (very) low, otherwise the resonant frequency may be too low to be exploited, switching of the diverter valve may not occur and the pump may stall.

Referring now to FIG. 1, this illustrates one preferred embodiment of a liquid suction pump 10 according to the invention. The pump comprises a drive pipe 11 to receive a liquid drive flow for the pump, a liquid conduit 12 having first and second liquid delivery arms 13, 14 to provide pumped liquid, and a connecting valve arrangement 15 between the arms. There are first and second pump inlets 16, 17 to the first and second arms, the first and second pump inlets having respective first and second one-way inlet valves. The valve arrangement has a valve inlet coupled to the drive pipe and valve outlets coupled to the first and second arms, to alternately close off a liquid connection between the valve inlet and respective ones of the first and second arms.

Thus the suction pump is configured such that, in operation, the drive flow oscillates in pressure/flow rate due to alternate switching of the valve arrangement. A compliant element 18 is coupled to the drive pipe and a compliance of the compliant element is chosen such that a geometry of the suction pump in combination with the compliance defines a resonant condition for the pump. Thus the oscillation is at or substantially close to a resonant frequency of the pump. Nonetheless the skilled person will understand that flow-friction effects, for example, may modify this resonance from its idealised inviscid value.

In some preferred applications the liquid suction pump is orientated substantially vertically and the drive pipe and liquid delivery arms may then extend the height of the apparatus. In such arrangements, the pump may be employed, for example, to lift water from a lower level in a well or borehole to a higher level above ground level.

In embodiments there are two acceleration phases of the operating cycle and two delivery phases of the operating cycle.

Figure 2:
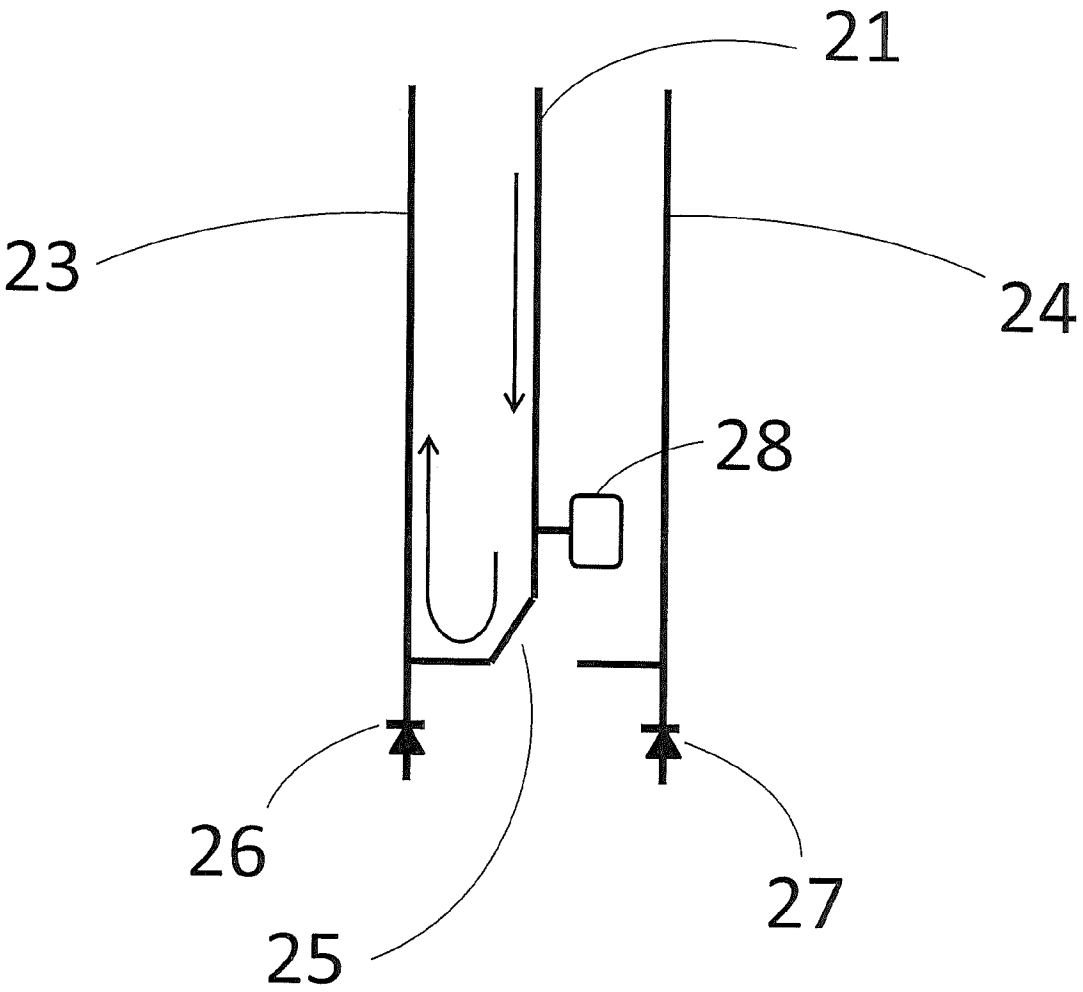
FIG. 2 shows the beginning of an acceleration phase for one of the liquid delivery arms.

One of the acceleration phases occurs when the fluid in a first liquid delivery arm is accelerated from rest, as illustrated in FIG. 2.

Referring now to FIG. 2, an embodiment of the invention is shown based on the preferred embodiment of FIG. 1 and in which the valve arrangement is a diverter valve 25 which may, for example, take the form of a shuttle valve having a closure element able to shuttle back and forth within a pipe between end stops to either side of the valve inlet.

It is understood that, in embodiments, the diverter valve may be oriented on any axis, though it may be preferable to orient it with an outlet port thereof either at right angles to, or parallel to the drive pipe or one of the liquid delivery arms.

In the embodiment shown in FIG. 2, the first liquid delivery arm 23 is shown in an acceleration phase thereof. At the beginning of this phase, the pressure in the compliant element 28 takes a value close to its minimum value—the condition for switching to occur that defines the end of one acceleration phase and the beginning of the next acceleration phase.

The flow rate in the first liquid delivery arm is initially close to zero whilst the drive flow is positive and downwards, resulting in a net positive flow into the compliant element, causing the pressure contained therein to rise. This rising pressure causes the liquid contained in the first liquid delivery arm to accelerate to a level beyond the level that would have occurred if the pressure in the compliant element had remained at its initial low value.

This acceleration is associated with its increasing kinetic energy. The resulting flow in the first delivery arm cannot be sustained by the drive flow so that the acceleration of the delivery flow decreases and the pressure in the compliant element returns to its initial value, in the manner of a resonant variation. This momentarily reverses the sealing force on the diverter valve, thereby causing it to actuate closing first delivery arm 23 and causing liquid to be sucked in through inlet 26, expending the kinetic energy in the flow contained within. This process is repeated in the second liquid delivery arm 24, ultimately causing liquid to be sucked in through inlet 27, thus completing one cycle of the pump.

Figure 3:
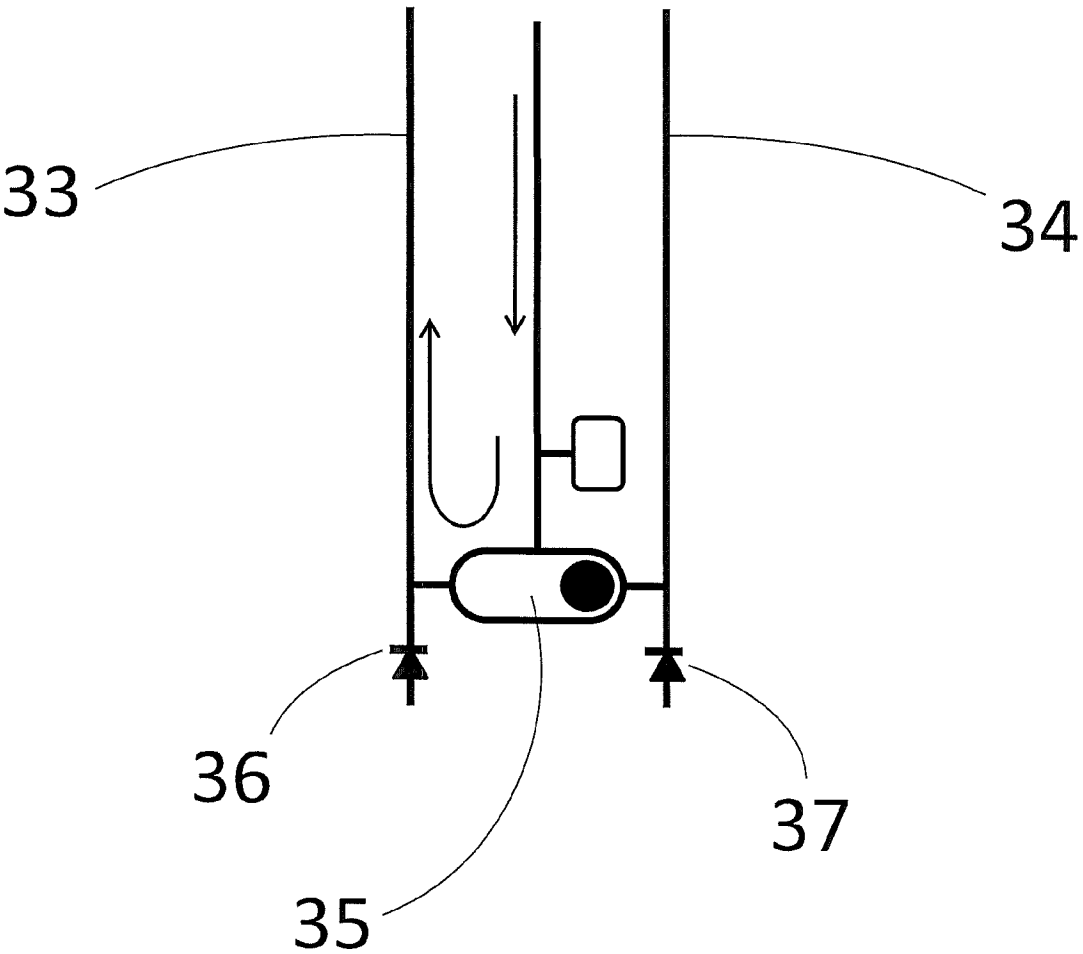
FIG. 3 shows an embodiment of the invention in which the valve arrangement comprises a shuttle valve having a closure element able to shuttle back and forth within a pipe between end stops to either side of the valve inlet.

FIG. 3 shows further details of an example of the pump shown in FIG. 2. Thus, referring FIG. 3, the diverter valve comprises a shuttle valve 35 having a closure element able to shuttle back and forth within a pipe between end stops to either side of the diverter valve inlet. The pump of FIG. 3 is shown at the beginning of the acceleration phase of the first liquid delivery arm 33, later giving rise to sucking of liquid through inlet 36, the subsequent phase thereof causing acceleration of liquid in the second liquid delivery arm 34, giving rise to sucking of liquid through inlet 37. The travel of the shuttle may be large, resulting in a wide opening; this is facilitated by operation that is substantially resonant and independent of the Venturi effect and viscous drag.

Figure 4:
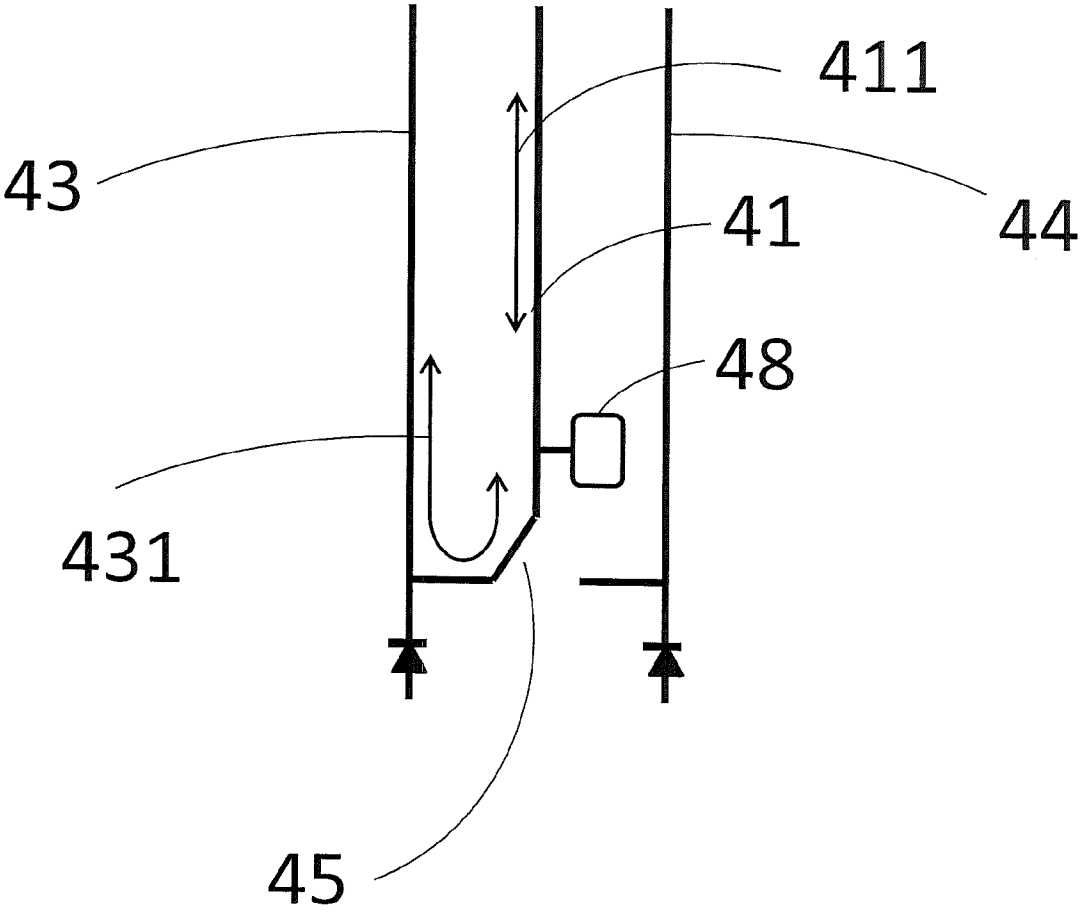
FIG. 4 illustrates the operation of the pump of FIG. 2, where the flow rates indicated at each point are the actual flow rates minus the time averaged flow rates at that point, and wherein the pump is driven with a substantially constant pressure drive flow at an entry to the drive pipe.

FIG. 4 shows the arrangement of FIG. 2 with the drive flow driven by a substantially constant pressure drive flow at an entry to the drive pipe. By way of example, but not exclusively, this may comprise a tank at a fixed level that is greater than the delivery level. Another example may comprise a pump, for example a centrifugal pump with an accumulator at its outlet. In FIG. 4, the liquid flow rate in drive pipe 41 is shown with its time averaged value subtracted as bi-directional arrow 411, indicating an oscillatory flow in the modified reference frame. Similarly, the accelerating flow in the first liquid delivery arm 43 is shown with its time averaged value subtracted as bi-directional arrow 431. In this reference frame, all flows originate or terminate in compliant element 48 in the manner of a resonant variation with a frequency determined by a combination of a geometry of the drive pipe 41, the delivery arms 43, 44 and the compliance 48, and there are substantially no net flows into or out of the first delivery arm during the acceleration phase therein.

Figure 5:
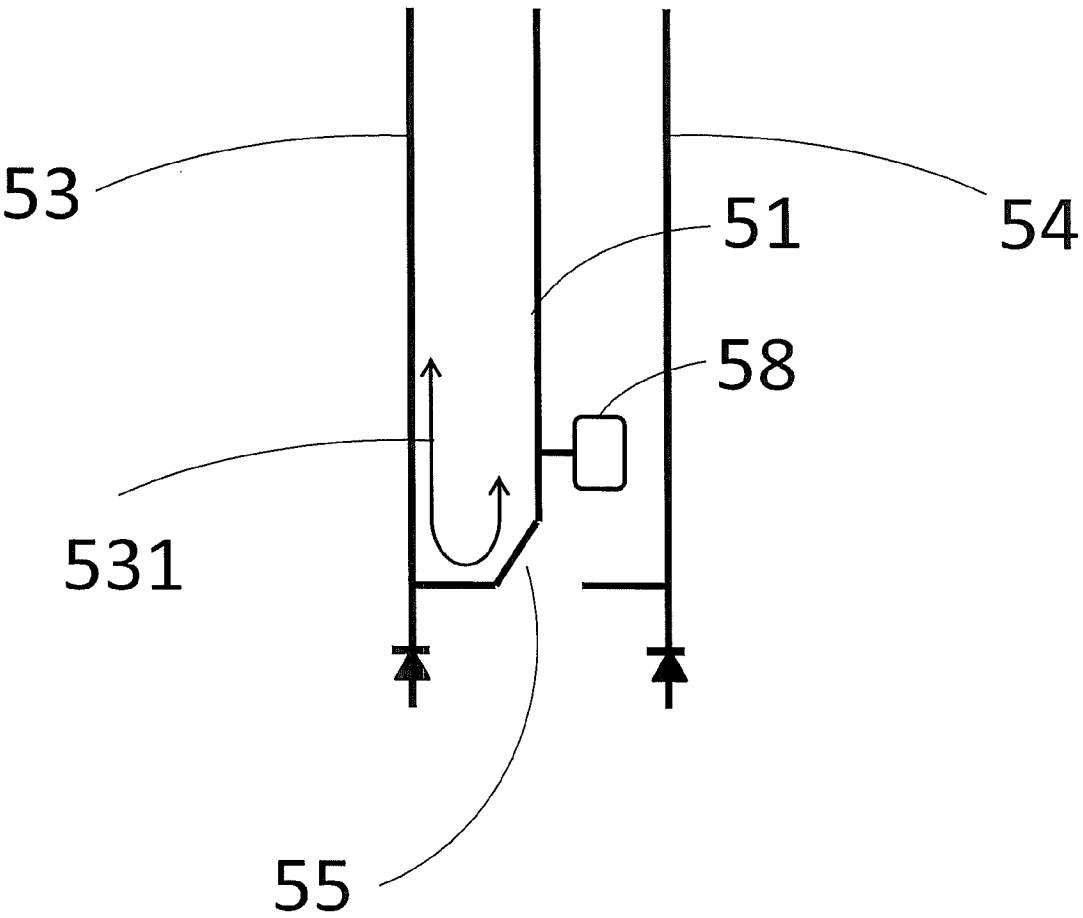
FIG. 5 illustrates the operation of the pump of FIG. 2, where the flow rates indicated at each point are the actual flow rates minus the time averaged flow rates at that point, and wherein the pump is driven with a substantially constant flow rate at an entry to the drive pipe.

FIG. 5 shows the arrangement of FIG. 2 with the drive flow driven by a substantially constant drive flow rate at an entry to the drive pipe. By way of example, but not exclusively, this might comprise a displacement pump operated at approximately constant speed. In FIG. 5 the liquid flow rate in drive pipe 51 is shown with its time averaged value, which is close to zero. Similarly, the accelerating flow in the first liquid delivery arm 53 is shown with its time averaged value subtracted as bi-directional arrow 531. In this reference frame, all flows originate or terminate in compliant element 58 in the manner of a resonant variation with a frequency determined by a combination of a geometry of the delivery arms 53, 54 and the compliance 58 and there are substantially no net flows into or out of the first delivery arm during the acceleration phase therein.

Figure 6:
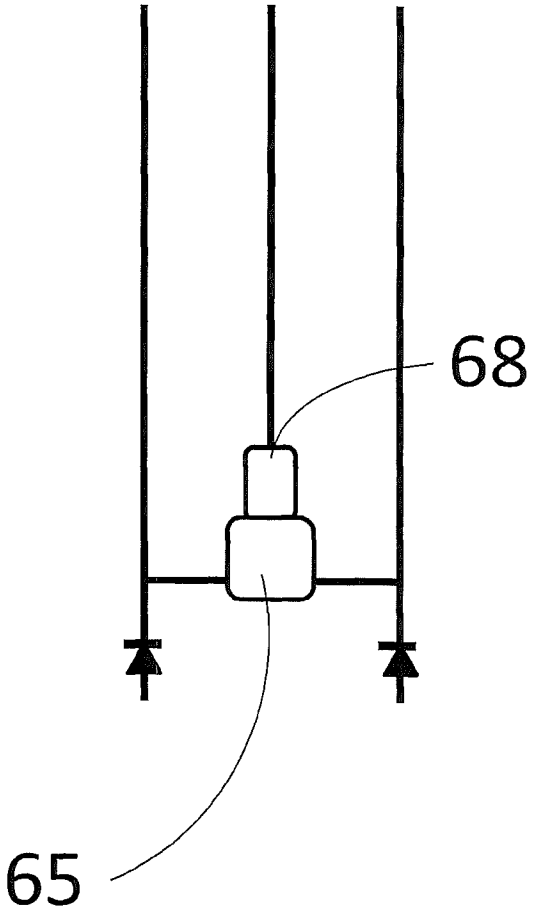
FIG. 6 shows an embodiment of the invention in which the compliant element is located at or adjacent the valve arrangement.

Referring now to FIG. 6, the compliant element 68 may be located at or adjacent the valve arrangement with the intention that the pressure in the compliant element is substantially the same as at the inlet to the valve arrangement at all times.

Figure 7:
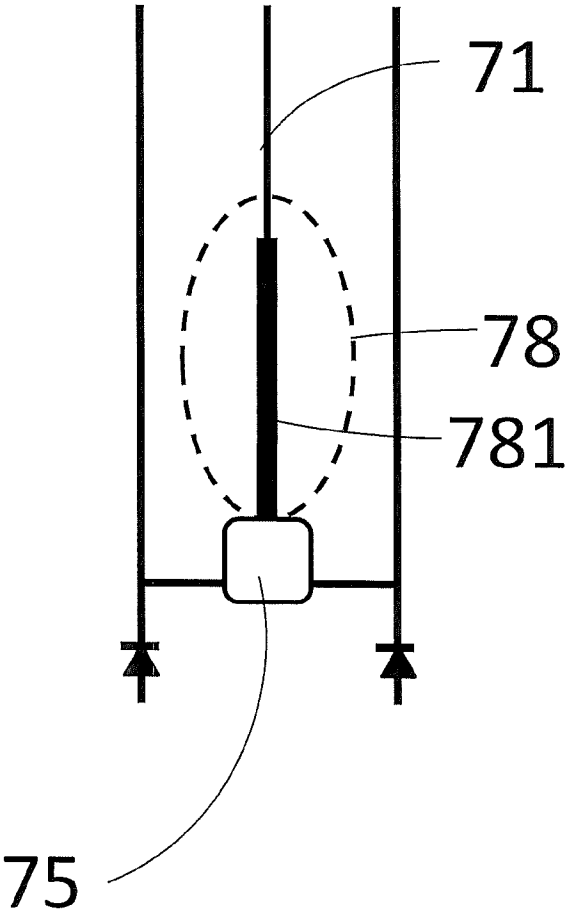
FIG. 7 shows an embodiment of the invention in which the compliant element comprises an elastic chamber or region coupled to or part of the drive pipe.

Referring now to FIG. 7, the compliant element 78 may comprise an elastic chamber or region 781 coupled to or part of the drive pipe 71. The elastic chamber may take the form of an elastic tube that forms a connection between the drive pipe and the inlet to the valve arrangement 75.

Figure 8:
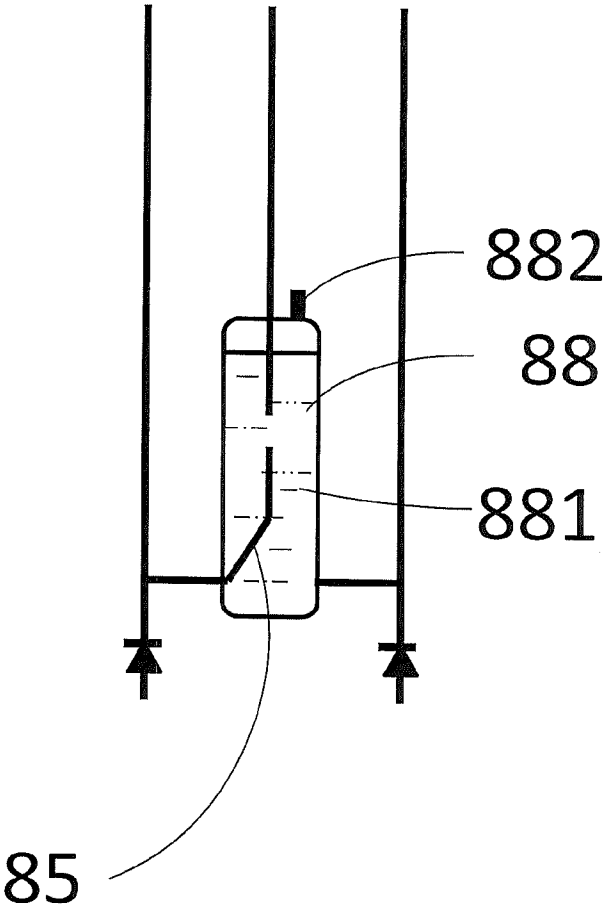
FIG. 8 shows an embodiment of the invention in which the compliant element comprises a buffer volume partly or wholly filled by gas, the mass of gas being adjustable within the buffer volume, the buffer volume further comprising a chamber enclosing the valve arrangement.

Referring now to FIG. 8, the compliant element 88 may comprise a buffer volume 881 partly or wholly filled by gas. The mass of gas in the buffer volume may be adjustable within the buffer volume, for example, by air-valve means 882. The buffer volume may be situated above or below the valve arrangement and/or the one-way inlet valves. Adjusting the mass of gas enables adjustment of the compliance of the complaint element. In all embodiments, the compliant element may further comprise a chamber enclosing the valve arrangement 85.

Figure 9:
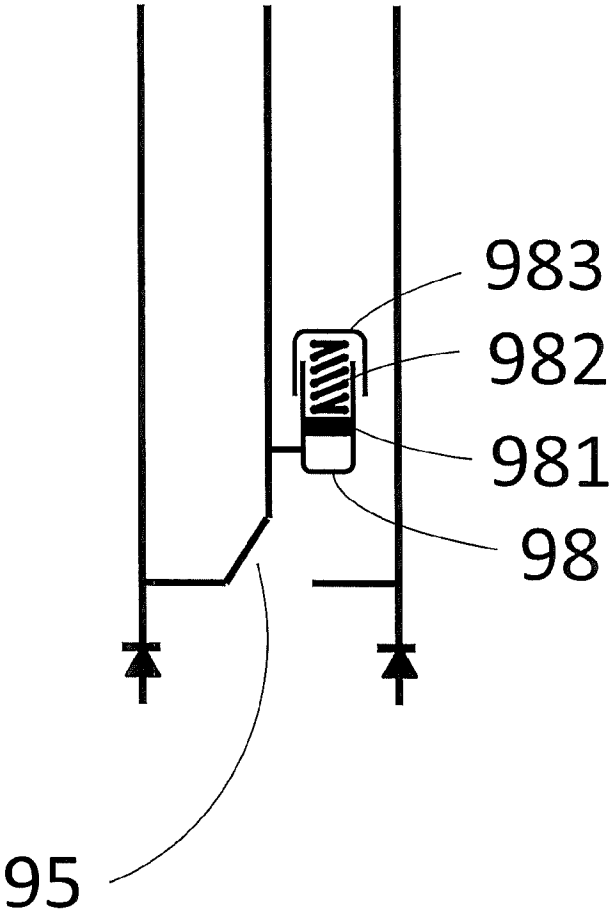
FIG. 9 shows an embodiment of the invention in which the compliant element comprises an adjustable spring-loaded piston having an adjustable pre-load.

Referring now to FIG. 9, the compliant element 98 may comprise a spring-loaded piston or diaphragm 981. The spring 982 may be interchangeable within the compliant element. The spring may have an adjustable pre-load that may be adjusted by means of a threaded adjustment screw, or cap 983.

Figure 10:
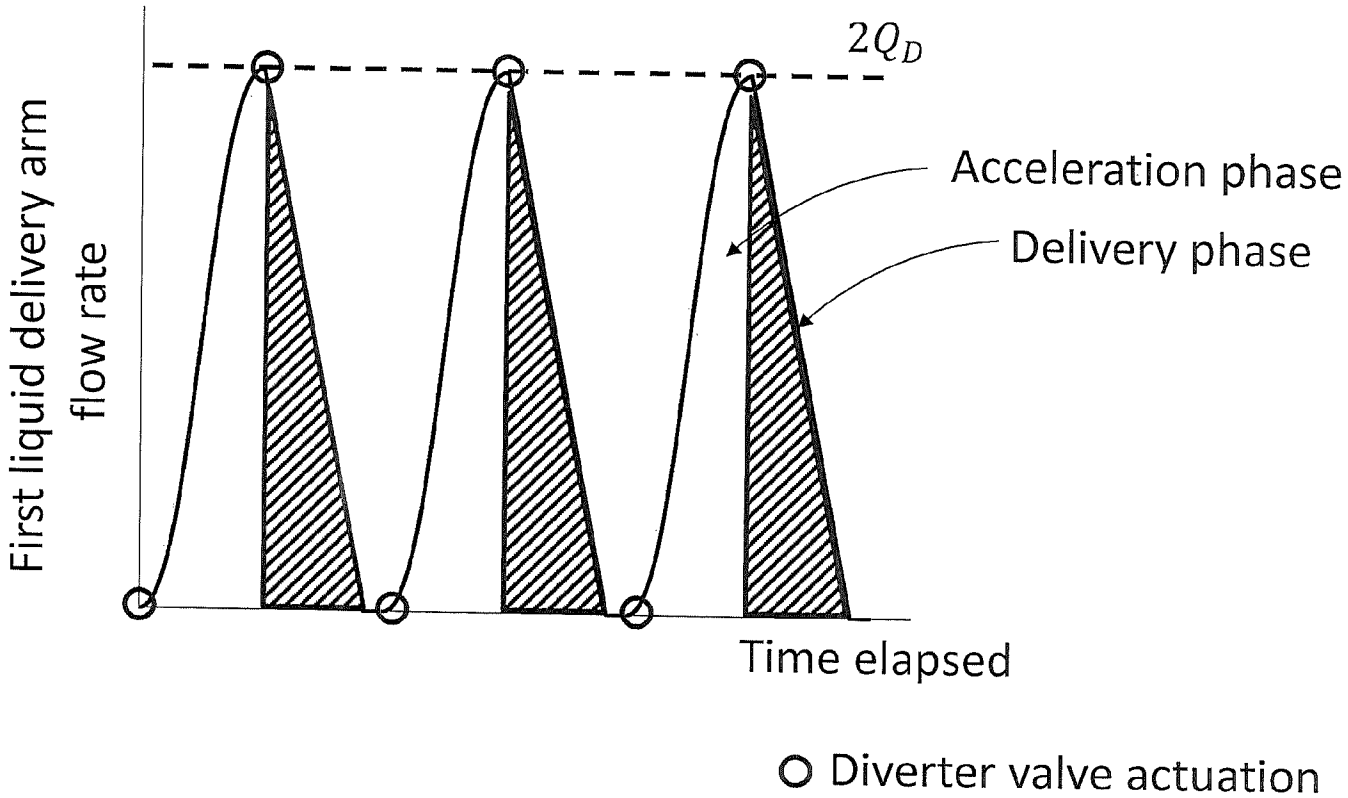
FIG. 10 shows flow rate variation in the first delivery pipe during three complete pumping cycles.

FIG. 10 illustrates the form of the fluid flow rate variation in the first liquid delivery arm during three complete pumping cycles under ideal conditions of zero loss and constant drive pipe flow rate, $Q_D$. The volume of fluid drawn in through the corresponding inlet that is permanently connected to the first liquid delivery arm is represented by the shaded areas under the curve.

Figure 11:
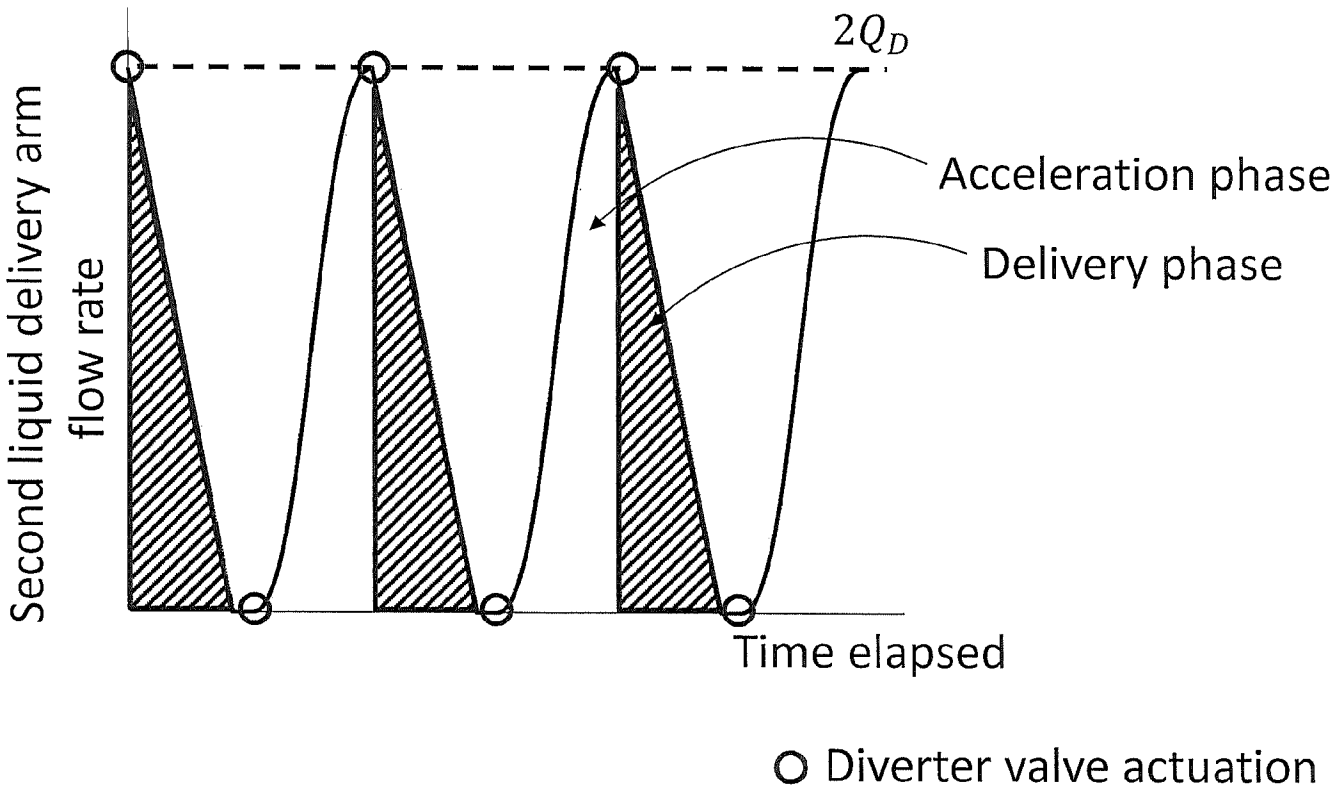
FIG. 11 shows (simplified) flow rate variation in the second delivery pipe during three complete pumping cycles.

FIG. 11 illustrates the form of the fluid flow rate variation in the second liquid delivery arm during three complete pumping cycles under ideal conditions of zero loss and constant drive pipe flow, $Q_D$. The volume of fluid drawn in through the corresponding inlet that is permanently connected to the second liquid delivery arm is represented by the shaded areas under the curve.

Figure 12:
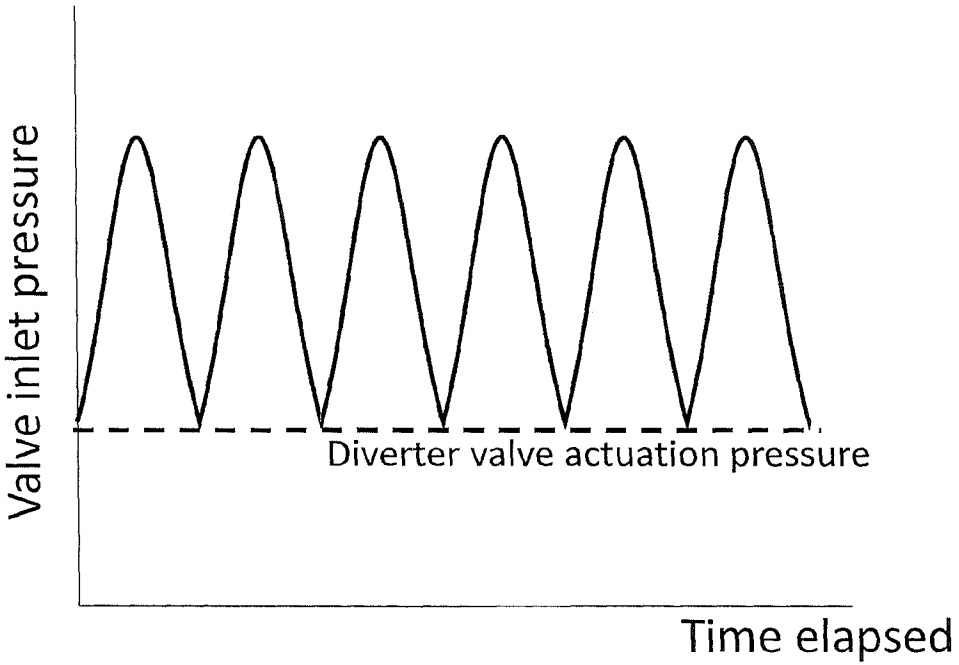
FIG. 12 shows the pressure variation at the valve inlet of the valve arrangement that acts on the compliant element during three complete pumping cycles.
Figure 13:
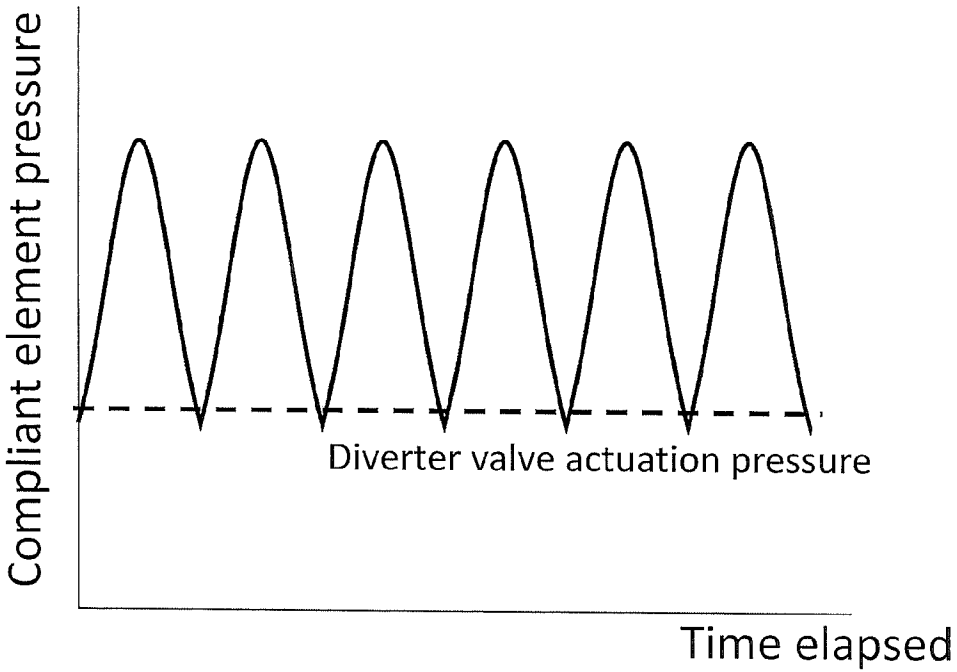
FIG. 13 shows pressure variation in the compliant element for flow rate and pressure variations corresponding to those shown in FIGS. 11 and 12.

The flow rate curves shown in FIGS. 11 and 12 are in anti-phase. The pressure variation in the compliant element corresponding to FIGS. 11 and 12 is illustrated in FIG. 13. The pressure variation assumes an idealised valve arrangement that switches immediately the pressure in the compliant element decreases to the pressure at which the valve arrangement actuates.

For such an idealised lossless system, under the scenario of constant drive pipe flow, $Q_D$, the system resonance frequency, f, in Hz, may be related to the compliant element compliance, C, and delivery pipe inertance, $I_L$, by the equation:

$$f = \frac{1}{2\pi}\sqrt{\frac{1}{I_L C}}.$$

whereas for such an idealised lossless system, under the scenario of a constant inlet pressure to the drive pipe, $p_D$, of inertance $I_D$, the system resonance frequency, f, in Hz, may be estimated by:

$$f = \frac{1}{2\pi}\sqrt{\frac{1}{I_L C} + \frac{1}{I_D C}}.$$

In practical embodiments, the observed time period, τ, of each delivery phase is greater than and approximately equal to $$\tau = 2nl/c$$

where n is the number of outgoing and return expansion wave passages in a delivery pipe, l is the length of each delivery pipe and c is the speed of sound through the liquid contained within the pipe.

This time period is associated with an actual oscillation frequency, $v = \frac{1}{2}\tau$, in Hz. It is generally advantageous, and the best efficiency of the pump is generally observed, if the resonance frequency f is tuned by varying the compliance C so that f becomes substantially equal to v wherein $$C = \frac{4}{I}\left(\frac{nl}{\pi c}\right)^2$$

where $I = I_L$ under the scenario of constant $Q_D$ and $I = I_L I_D/(4 + I_D)$ under the scenario of constant $p_D$. The best global efficiencies may generally be obtained when n=1, although it may be preferable to operate the pump with n>1, for example, to preserve the lifetime of components and/or where pipe diameters are constrained by the application and/or where high ratios of drive and delivery pressures are desired.

Now we consider the global efficiency of a system comprising the pump wherein the drive flow is provided by a drive pump, for example, a centrifugal pump located at surface level. We refer to the drive pump as the "driver", for clarity. The global efficiency of the complete system may be defined as the product of the individual efficiencies of the pump and the driver. In an inviscid approximation, it can be shown that the input impedance Z of the pump is $$Z = \frac{p_D}{Q_D} = \frac{2}{\pi}\sqrt{\frac{I}{C}}$$

where $p_D$ and $Q_D$ are interpreted as time-averaged quantities where necessary.

The Best Efficiency Point (BEP) of the driver occurs at a particular value (ratio) of $p_D$ and $Q_D$ corresponding to a particular value of the pump input impedance, which may be denoted by $Z_{BEP}$. The value of $Z_{BEP}$ is dictated by the driver.

The driver can be forced to operate at its BEP by setting the compliance of the pump's compliant element to a value of approximately $$C = I\left(\frac{2}{\pi Z_{BEP}}\right)^2$$

The pump may operate at its best efficiency whilst forcing the driver to operate simultaneously at its best efficiency if the two expressions for C presented above are substantially equal, wherein $$C \leq \frac{4nl}{\pi^2 c Z_{BEP}}$$

$$I \leq \frac{nlZ_{BEP}}{c}$$

In practical embodiments, flow-friction may add significant additional impedance to the pump with the result that the global optimum compliance and inertance may be less than the values presented above. Thus when friction is taken into account the above inequality for C may change to $$C \approx \frac{4nl}{\pi^2 c Z_{BEP}}$$

or even $$C \geq \frac{4nl}{\pi^2 c Z_{BEP}}.$$

Referring again to the above equations, a first preferable optimization for the compliant element relates to the pump and has $IC \sim l^2$, a second preferable optimization for the compliant element relates to the driver and has $$C/I \sim \left(\frac{1}{Z_{BEP}}\right)^2,$$

and a combined preferable optimization has $$C \sim \frac{l}{Z_{BEP}}; \text{ with } I \sim lZ_{BEP}.$$

Higher power outputs and efficiencies generally correlate with an increase in resonance frequency, which correspond to a lower compliance (stiffer system) for given inertances. In a practical embodiment, adjustments can be made for system losses.

As resonance frequency decreases, efficiency generally decreases but drive flow generally increases. As resonance frequency increases, efficiency generally increases but drive flow generally decreases. At very high frequencies, viscous losses associated with the switching process may dominate over the gains made due to lower flow friction losses in pipework.

The optimum frequency may thus be chosen to set the input impedance of the suction ram to match the maximum power point (pressure versus flow rate) of the drive system head-flow curve. This may be achieved by setting an appropriate value of the compliance of the compliant element for given pipe inertances.

Embodiments of such pumps will self-start with very modest drive flow rates, far lower than those which are needed to affect venturi-driven switching, facilitated by a component of unsteadiness in the drive flow. This may be achieved electronically at start-up (if the drive flow is provided by an electrically powered pump) or fluid-mechanically with an appropriate additional flow element designed to generate an unsteadiness in the drive pipe or one or both of the liquid delivery arms. When the drive flow is provided by a system with a significant time varying output, such as a displacement pump, self-starting has been found to occur spontaneously and reliably.

Embodiments of the above described pumps/methods provide advantages including minimal failures, low production cost enabled by a low number of moving parts (particularly sliding seals), and an ability to be driven by a wide range of drive pumps or sources of flowing liquid. In embodiments the operational frequency can be changed/controlled by changing the compliance of the compliant element. A further advantage of embodiments is that relatively high frequency operation can be sustained, minimising the average velocity of liquid in the drive pipes and liquid delivery arms and thereby minimising flow-friction losses.

A further advantage of embodiments of the invention is that the diverter valve may have a much wider opening, since it need not be designed to encourage static pressure reduction through the Venturi effect, or viscous drag. This results in lower hydrodynamic losses in the diverter valve. Embodiments of the pump are able to operate with a relatively low minimum drive flow rate, and are able to pump liquid efficiently across a wide range of drive pressures and drive flow rates.

Some preferred embodiments of the pump have a vertical arrangement of drive pipes, delivery pipes and diverter valve for the application of lifting water from a well or borehole. No doubt many other effective alternatives will occur to the skilled person. It will be understood that the invention is not limited to the described embodiments and encompasses modifications apparent to those skilled in the art lying within the spirit and scope of the claims appended hereto.

The invention claimed is:

1. A liquid suction pump in combination with a pump driver, the pump comprising:

a drive pipe to receive a liquid drive flow for the pump, the pump driver being coupled to said drive pipe;

a liquid conduit having first and second liquid delivery arms to provide pumped liquid, and a connecting valve arrangement between the arms;

first and second pump inlets to said first and second arms, said first and second pump inlets having respective first and second one-way inlet valves;

said valve arrangement having a valve inlet coupled to said drive pipe and valve outlets coupled to said first and second arms, to alternately close off a liquid connection between said valve inlet and respective ones of said first and second arms; and a compliant element coupled to said drive pipe;

wherein the suction pump is configured such that, in operation, said drive flow oscillates in pressure/flow rate at an operational frequency due to alternate switching of said valve arrangement; and wherein a compliance of said compliant element is such that a geometry of said suction pump in combination with said compliance defines a resonant condition for said pump and a resonant frequency of the pump is matched to the operational frequency of the suction pump, wherein the compliance of said compliant element is substantially equal to, or defined by:

$$\frac{4nl}{\pi^2 c Z_{BEP}},$$

where c is the speed of sound through the water in the liquid delivery arms, l is a length of one or both liquid delivery arms, n is a positive integer and $Z_{BEP}$ is an input impedance of the pump at a best efficiency point of the pump driver.

2. The liquid suction pump in combination with the pump driver as claimed in claim 1, wherein said oscillation causes said switching, and wherein the amplitude of a pressure variation of said resonant oscillation, at said valve arrangement, is sufficient to switch said valve arrangement between alternate positions when said pressure is at a minimum.

3. The liquid suction pump in combination with the pump driver as claimed in claim 1, wherein said valve arrangement comprises a shuttle valve having a closure element able to shuttle back and forth within a pipe between end stops to either side of said valve inlet.

4. The liquid suction pump in combination with the pump driver as claimed in claim 1, wherein the compliant element comprises elastic chamber or region which at least partially contains said valve arrangement.

5. The liquid suction pump in combination with the pump driver as claimed in claim 1, wherein the valve arrangement comprises a paddle mounted for rotation about a vertical axis.

6. The liquid suction pump in combination with the pump driver as claimed in claim 1, wherein the pump driver is coupled to said drive pipe; and wherein the compliance of said compliant element additionally sets the pump driver to the best efficiency point.

7. A method of operating a suction pump as claimed in claim 1, the method comprising:

flowing liquid substantially continuously into said drive pipe and out alternately through each of said delivery arms, and sucking further liquid into the inlet valve of each delivery arm as liquid from the drive pipe is flowing out through the arm; and selecting or adjusting a compliance of said compliant element such that the geometry of said suction pump in combination with said compliance defines a resonant condition for said pump.

8. The method as claimed in claim 7, wherein said resonant condition is defined by a combination of a geometry of said drive pipe and/or said delivery arms, and said compliance.

9. The method as claimed in claim 7, further comprising driving said pump with a substantially constant pressure drive flow at an entry to said drive pipe, and locating said compliant element between said entry and said valve arrangement.

10. The method as claimed in claim 7, further comprising driving said pump with a substantially constant flow rate at an entry to said drive pipe.

11. The pump in combination with the pump driver as claimed in claim 1, wherein said compliant element is located at or adjacent said valve arrangement and comprises an elastic chamber or region coupled to or part of said drive pipe defining a buffer volume partly or wholly filled by gas.

12. The pump in combination with the pump driver as claimed in claim 11, wherein said buffer volume comprises a chamber enclosing said valve arrangement.

13. The pump in combination with the pump driver as claimed in claim 1, wherein said compliant element comprises a spring-loaded piston or diaphragm, wherein said spring-loaded piston or diaphragm has an adjustable preload.

14. The pump in combination with the pump driver as claimed in claim 2, wherein an amplitude of the pressure variation in or at the compliant element is equal to or greater than a differential in pressure across the valve arrangement between the valve inlet and a closed-off valve outlet.

15. The method as claimed in claim 7, further comprising:

providing a valve arrangement comprising a valve inlet coupled to the drive pipe and valve outlets coupled to the delivery arms, to alternately close off a liquid connection between the valve inlet and respective ones of the delivery arms;

operating the suction pump such that the flowing liquid oscillates in pressure and flow rate due to alternate switching of said valve arrangement; and using the oscillation to cause the switching, wherein the amplitude of a pressure variation of a resonant oscillation of the pump, at the valve arrangement, is sufficient to switch the valve arrangement between alternate positions when the pressure is at a minimum, and wherein an amplitude of the pressure variation in or at a compliant element of the pump is equal to or greater than a differential in pressure across the valve arrangement between the valve inlet and a closed-off valve outlet.

16. A method of operating a liquid suction pump, the pump comprising:

a drive pipe to receive a liquid drive flow for the pump;

a liquid conduit having first and second liquid delivery arms to provide pumped liquid, and a connecting valve arrangement between the arms;

first and second pump inlets to said first and second arms, said first and second pump inlets having respective first and second one-way inlet valves;

said valve arrangement having a valve inlet coupled to said drive pipe and valve outlets coupled to said first and second arms, to alternately close off a liquid connection between said valve inlet and respective ones of said first and second arms; and a compliant element coupled to said drive pipe; the method comprising:

operating the suction pump such that said drive flow oscillates in pressure/flow rate due to alternate switching of said valve arrangement, and such that an amplitude of the pressure variation in or at the compliant element is equal to or greater than a differential in pressure across the valve arrangement between the valve inlet and a closed-off valve outlet;

locating said compliant element at or adjacent said valve arrangement; and switching said valve arrangement between alternate positions when a pressure at said valve inlet is at a minimum.

17. The method as claimed in claim 16, wherein switching of the valve arrangement between alternate positions occurs substantially without venturi-effect assistance.

18. A liquid suction pump in combination with a pump driver, the pump comprising:

a drive pipe to receive a liquid drive flow for the pump, the pump driver being coupled to said drive pipe;

a liquid conduit having first and second liquid delivery arms to provide pumped liquid, and a connecting valve arrangement between the arms;

first and second pump inlets to said first and second arms, said first and second pump inlets having respective first and second one-way inlet valves;

said valve arrangement having a valve inlet coupled to said drive pipe and valve outlets coupled to said first and second arms, to alternately close off a liquid connection between said valve inlet and respective ones of said first and second arms; and a compliant element coupled to said drive pipe;

wherein the suction pump is configured such that, in operation, said drive flow oscillates in pressure/flow rate at an operational frequency due to alternate switching of said valve arrangement; and wherein a compliance of said compliant element is such that a geometry of said suction pump in combination with said compliance defines a resonant condition for said pump and a resonant frequency of the pump is matched to the operational frequency of the suction pump, wherein a characteristic inertance of the pump is less than or equal to $$\frac{nlZ_{BEP}}{c},$$

where c is the speed of sound through the water in the liquid delivery arms, l is a length of one or both liquid delivery arms, n is a positive integer which is a number of outgoing and return expansion wave passages in one or both liquid delivery arms and $Z_{BEP}$ is an input impedance of the pump at a best efficiency point of the pump driver.

19. The liquid suction pump in combination with the pump driver as claimed in claim 18, wherein said oscillation causes said switching, and wherein the amplitude of a pressure variation of said resonant oscillation, at said valve arrangement, is sufficient to switch said valve arrangement between alternate positions when said pressure is at a minimum.

20. The liquid suction pump in combination with the pump driver as claimed in claim 18, wherein said valve arrangement comprises a shuttle valve having a closure element able to shuttle back and forth within a pipe between end stops to either side of said valve inlet.

21. The liquid suction pump in combination with the pump driver as claimed in claim 18, wherein the compliant element comprises elastic chamber or region which at least partially contains said valve arrangement.

22. The liquid suction pump in combination with the pump driver as claimed in claim 18, wherein the valve arrangement comprises a paddle mounted for rotation about a vertical axis.

23. The liquid suction pump in combination with the pump driver as claimed in claim 18, wherein the pump driver is coupled to said drive pipe, and wherein the compliance of said compliant element additionally sets the pump driver to the best efficiency point.

24. The liquid suction pump as claimed in claim 18, wherein the compliance of said compliant element is substantially equal to, or defined by:

$$\frac{4nl}{\pi^2 c Z_{BEP}},$$

where c is the speed of sound through the water in the liquid delivery arms, l is a length of one or both liquid delivery arms, n is a positive integer and $Z_{BEP}$ is an input impedance of the pump at the best efficiency point of the pump driver.

25. A method of operating a suction pump as claimed in claim 18, the method comprising:

flowing liquid substantially continuously into said drive pipe and out alternately through each of said delivery arms, and sucking further liquid into the inlet valve of each delivery arm as liquid from the drive pipe is flowing out through the arm; and selecting or adjusting a compliance of said compliant element such that the geometry of said suction pump in combination with said compliance defines a resonant condition for said pump.

26. The pump in combination with the pump driver as claimed in claim 18, wherein said compliant element is located at or adjacent said valve arrangement and comprises an elastic chamber or region coupled to or part of said drive pipe defining a buffer volume partly or wholly filled by gas.

27. The pump in combination with the pump driver as claimed in claim 18, wherein said compliant element comprises a spring-loaded piston or diaphragm, wherein said spring-loaded piston or diaphragm has an adjustable preload.

* * * * *